US010156357B2

(12) United States Patent
Simpson

(10) Patent No.: US 10,156,357 B2
(45) Date of Patent: Dec. 18, 2018

(54) AUTOMATED CANDLE BLOWER

(71) Applicant: Rickey Simpson, San Antonio, TX (US)

(72) Inventor: Rickey Simpson, San Antonio, TX (US)

( * ) Notice: Subject to any disclaimer, the term of this patent is extended or adjusted under 35 U.S.C. 154(b) by 484 days.

(21) Appl. No.: 14/875,834

(22) Filed: Oct. 6, 2015

(65) Prior Publication Data

US 2017/0097157 A1 Apr. 6, 2017

(51) Int. Cl.
*F23Q 25/00* (2006.01)

(52) U.S. Cl.
CPC ..... *F23Q 25/00* (2013.01)

(58) Field of Classification Search
CPC ..... F23Q 25/00
See application file for complete search history.

(56) References Cited

U.S. PATENT DOCUMENTS 65,696 A * 6/1867 Shaw ..... F23Q 25/00 431/148
147,443 A * 2/1874 Stern ..... F23Q 25/00 431/145
160,988 A * 3/1875 Zimmerman ..... F23Q 25/00 431/145
297,879 A * 4/1884 Hoevenbergh ..... F23Q 25/00 431/145
1,114,551 A * 10/1914 Sztankovits ..... F23Q 25/00 431/34
1,918,808 A * 7/1933 Gurrell ..... F23Q 25/00 431/145
3,169,519 A * 2/1965 Aizawa ..... F24C 5/04 126/57
3,762,857 A * 10/1973 Andeweg ..... F21S 10/00 362/183
3,877,107 A * 4/1975 Cirino ..... B60S 3/06 15/302
3,905,746 A * 9/1975 Patrikios ..... A47G 33/00 431/145
6,112,891 A * 9/2000 Wohl ..... B65D 51/24 206/223
7,132,084 B1 * 11/2006 Roumpos ..... A61L 9/02 422/125
7,252,423 B1 * 8/2007 Wang ..... C11C 5/008 362/392
8,469,701 B2 * 6/2013 Quinn ..... F23D 3/16 215/235
2007/0072140 A1 * 3/2007 Almodovar ..... F23D 3/16 431/289
2007/0184395 A1 * 8/2007 Taylor ..... F23D 3/16 431/33
2008/0076082 A1 * 3/2008 Wolfson ..... F23Q 25/00 431/145
2011/0244406 A1 * 10/2011 Simpson ..... F23D 3/16 431/6
2014/0134552 A1 * 5/2014 Trevino ..... F23Q 25/00 431/152

* cited by examiner

*Primary Examiner* — Kenneth Rinehart
*Assistant Examiner* — Logan Jones
(74) *Attorney, Agent, or Firm* — Scherrer Patent & Trademark Law, P.C.; Stephen T. Scherrer; Monique A. Morneault

(57) ABSTRACT

The present invention relates to a candle blower. More specifically, the present invention is an automated candle blower programmable to direct a flow of air to the general position of a flame on a burning candle.

20 Claims, 2 Drawing Sheets

AUTOMATED CANDLE BLOWER

TECHNICAL FIELD

The present invention relates to a candle blower. More specifically, the present invention is an automated candle blower programmable to direct a flow of air to the general position of a flame on a burning candle.

BACKGROUND

According to one government study, in 2006, an estimated 23,600 fires in residences were caused by candles, resulting in 1525 civilian injuries, 165 deaths, and $390 million in property damage. Unattended burning candles caused a large portion of these fires.

Numerous attempts have been made to address the problem of unattended, burning candles and the dangers they present. For example, U.S. Pat. No. 7,226,284 (issued on Jun. 5, 2007) describes a controller electrically connected to a fan that, when actuated, forces air into a transparent cover. A series of openings are formed in the candle support. The invention of the '284 patent operates by continually providing air into the cover through the openings for so long as candle burning is desired. To extinguish the candle, air flow is stopped—that is, the fan is deactivated.

U.S. Published Application 2008/0076082 (published Mar. 27, 2008) also incorporates a fan orientated to create a horizontal air stream toward a flaming wick of a candle. The invention also incorporates a countdown timer. The invention may be remotely actuated with a transmitter.

U.S. Published Application 2007/0072140 (published Mar. 29, 2007) describes a system that includes a base with an extinguishing fluid situated within the base. Movement of a solenoid arm causes actuation of a spray nozzle to direct fluid, such as air, to the top of the candle through channels formed in a shell in which the candle is placed. The solenoid is actuated after a predetermined elapsed time, when a specific temperature is reached, or if a tilt sensor is triggered.

U.S. Pat. No. 7,132,084 (issued Nov. 7, 2006) discloses a candle warmer having a base and a fan orientated to direct air flow close to a candle resting on the base. This invention is not intended to control the flame of the candle, but rather to disperse the smell from the scented wax.

Heretofore, devices utilized for automatically extinguishing a candle suffer from an inability to specifically direct a flow of air to the position of the candle flame. Therefore, prior devices may fail to properly extinguish the candle flame at the desired time. In addition, prior devices utilize relatively bulky and unsightly mechanisms to attempt to ensure that the candle flame extinguishes, which negatively impacts a user's enjoyment of the candle.

A need, therefore, exists for an automated candle blower that may be used to automatically, efficiently, and unfailingly extinguish a lighted candle. Specifically, a need exists for an automated candle blower that extinguishes a lighted candle at a desired time.

Moreover, a need exists for an automated candle blower that unobtrusively extinguishes a candle. Specifically, a need exists for an automated candle blower that does not interfere with a user's enjoyment of the lighted candle.

In addition, a need exists for an automated candle blower that is easy to use and provides peace of mind to a user that a candle will be extinguished automatically at the time desired by the user. Further, a need exists for an automated candle blower that incorporates auditory capabilities, such as the ability to audible sounds, such as music, to a user thereof.

SUMMARY OF THE INVENTION

The present invention relates to a candle blower. More specifically, the present invention is an automated candle blower programmable to direct a flow of air to the general position of a flame on a burning candle.

To this end, in an embodiment of the present invention, an automated candle blower is provided. The automated candle blower comprises: a base comprising a candle support surface and an arm pivotally connected to the base, wherein the arm is configured to extend over the candle, wherein the arm further comprises a plurality of holes configured to direct a stream of air at the candle for extinguishing a flame on the candle; a blower positioned to direct air within the arm and through the plurality of holes in the arm, wherein said directed air extinguishes the flame on the candle; and a timer configured to pivot the arm so that the arm extends over the candle at a predetermined time.

In an embodiment, the automated candle blower further comprises a motor engaged with the arm, wherein the motor is configured to pivot the arm and extend the arm over the candle at the predetermined time.

In an embodiment, the automated candle blower further comprises a control circuit having a processor and a timer, said control circuit being electrically connected to the blower; and a control panel electronically connected to the control circuit.

In an embodiment, the automated candle blower further comprises a latch configured to hold the arm adjacent the base; and a spring engaged with the arm, wherein the timer releases the latch and the spring causes the arm to pivotally extend over the candle.

In an embodiment, the automated candle blower further comprising: a passage within the arm for directing air from the blower to the plurality of holes in the arm.

In an embodiment, the arm is arcuately-shaped.

In an embodiment, the arm extends arcuately from one side of the base to the other side of the base.

In an embodiment, the arm extends arcuately partially from one side of the base to the side of the base.

In an embodiment, the candle support surface comprises a well within the base.

In an embodiment, the well comprises a bottom surface and at least one support wall.

In an embodiment, the automated candle blower further comprises at least one light on the support wall configured to shine against the candle held within the well.

In an embodiment, the light is an LED.

In an embodiment, the plurality of holes is oriented to direct air radially toward the candle.

In an embodiment, the plurality of holes are angled downwardly relative to a horizontal plane.

In an embodiment, the automated candle blower further comprises a speaker within the base configured to play sounds.

In an alternate embodiment of the present invention, a method of extinguishing a candle is provided. The method comprises the steps of: providing a base comprising a candle support surface and an arcuately-shaped arm pivotally connected to the base, wherein the arm is configured to extend over the candle, wherein the arm further comprises a plurality of holes configured to direct a stream of air at the candle for extinguishing a flame on the candle, a blower positioned to direct air within the arm and through the plurality of holes in the arm, wherein said directed air extinguishes the flame on the candle, and a timer configured to pivot the arm so that the arm extends over the candle at a predetermined time; supporting a candle on the candle support surface; activating a blower at a first time; pivoting the arcuately-shaped arm to extend over the candle on the candle support surface; directing air flow from the blower to the plurality of holes in the arm, wherein the air flow extinguishes a lit candle; and deactivating the blower.

In an embodiment, the method further comprises the steps of: accepting first user input with a control panel, the user input being representative of the value of a first time variable; providing the first user input to a control circuit electrically connected to the blower, the control circuit comprising a processor and a timer; deriving the first time from the first time variable.

In an embodiment, the method further comprises the steps of: accepting second user input with the control panel, the second user input representative of the value of a second time variable; providing said second user input to the control circuit; deriving a second time from the second time variable; and deactivating the blower at the second time.

In an embodiment, the directing step comprises the step of channeling air flow through a passage within the arm and through the plurality of air holes.

In an embodiment, the step of pivoting the arm includes using a motor to cause the arm to pivot and extend over the candle on the candle support surface.

It is, therefore, an advantage and objective of the present invention to provide an automatic candle blower that may be used to automatically, efficiently, and unfailingly extinguish a lighted candle.

Specifically, it is an advantage and objective of the present invention to provide an automatic candle blower that extinguishes a lighted candle at a desired time.

Moreover, it is an advantage and objective of the present invention to provide an automatic candle blower that unobtrusively extinguish a candle.

Specifically, it is an advantage and objective of the present invention to provide an automatic candle blower that does not interfere with a user's enjoyment of the lighted candle.

In addition, it is an advantage and objective of the present invention to provide an automatic candle blower that is easy to use and provides peace of mind to a user that a candle will be extinguished automatically at the time desired by the user.

Further, it is an advantage and objective of the present invention to provide an automatic candle blower that incorporates auditory capabilities, such as the ability to audible sounds, such as music, to a user thereof.

Additional features and advantages of the present invention are described in, and will be apparent from, the detailed description of the presently preferred embodiments and from the drawings.

BRIEF DESCRIPTION OF THE DRAWINGS

The drawing figures depict one or more implementations in accord with the present concepts, by way of example only, not by way of limitations. In the figures, like reference numerals refer to the same or similar elements.

DETAILED DESCRIPTION OF THE PRESENTLY PREFERRED EMBODIMENTS

The present invention relates to a candle blower. More specifically, the present invention is an automated candle blower programmable to direct a flow of air to the general position of a flame on a burning candle.

Figure 1:
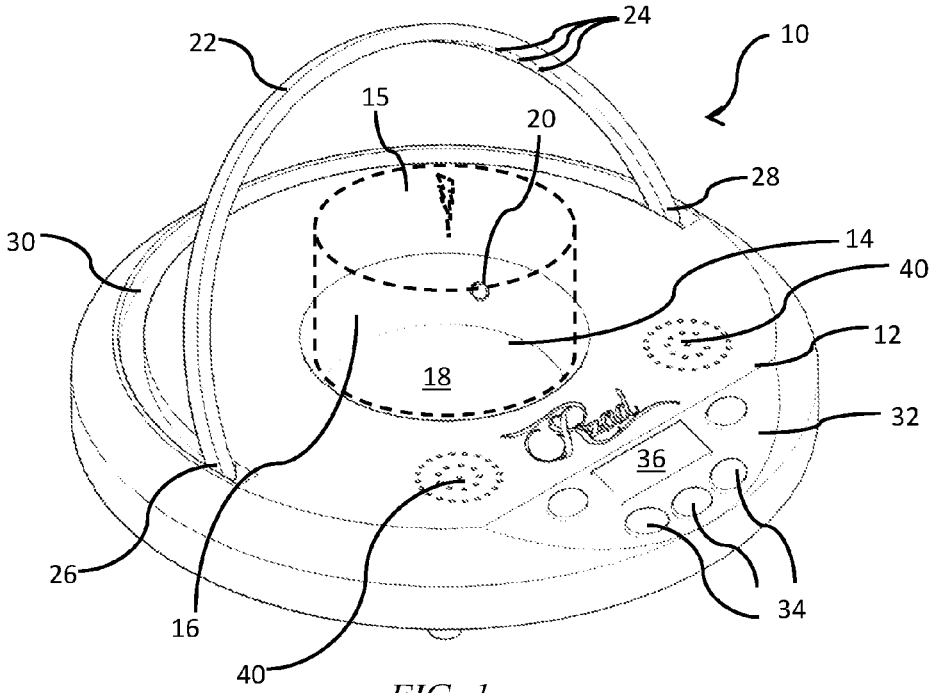
FIG. 1 illustrates a perspective view of an automatic candle blower in an embodiment of the present invention.

Now referring to the figures, wherein like numerals refer to like parts, FIG. 1 illustrates an automated candle blower 10 in an embodiment of the present invention. Specifically, the automated candle blower 10 comprises a base 12 having a candle holding well 14 disposed centrally within the base 12 for holding a candle 15 (in phantom) therein. The well 14 may have a sidewall 16 and a bottom 18 therein for holding a portion of the candle therein. One or more lights 20 may be contained within the sidewall 16 for lighting the candle disposed therein. Preferably, the one or more lights 20 may be LEDs that may shine on a candle and cause the candle to appear as if it is glowing internally. For this, a candle having a transparency or, preferably, a translucency may be utilized to cause this effect.

The one or more lights 20 may be one color or a plurality of different colors. The one or more lights 20 may remain on one colored light, may cycle through the plurality of different colors, may be steady and always on, may flash, strobe, or shine in any other manner apparent to one of ordinary skill in the art. One or more buttons, switches or other light controllers (not shown) may be disposed on the base 12 for activating the one or more lights 20, and for cycling through the plurality of different colors or other settings.

An arcuately-shaped arm 22 may extend from the base 12 having a plurality of air holes 24 disposed on an underside of the arm 22. The plurality of air holes 24 may provide a stream of air from the arm 22, directed to the candle that may be disposed in the well 14. Thus, as a lighted candle sits within the well 14, the arcuately-shaped arm may extend over the lighted candle and provide a stream of air to the location of the flame of the candle, thereby extinguishing the same.

The plurality of air holes 24 may be positioned along a portion of the arcuately-shaped arm 22 sufficient to provide a significant amount of air when air is streamed through the arm 22 and through the holes. The significant amount of air is sufficient to extinguish the flame of the lighted candle sitting in the well 14. Because the plurality of air holes are positioned along the underside of the arcuately-shaped arm 22, each of the air holes is directed to a focused point in the center of the base 12, roughly to the position of the lighted flame of the candle that may be disposed therein.

Figure 2:
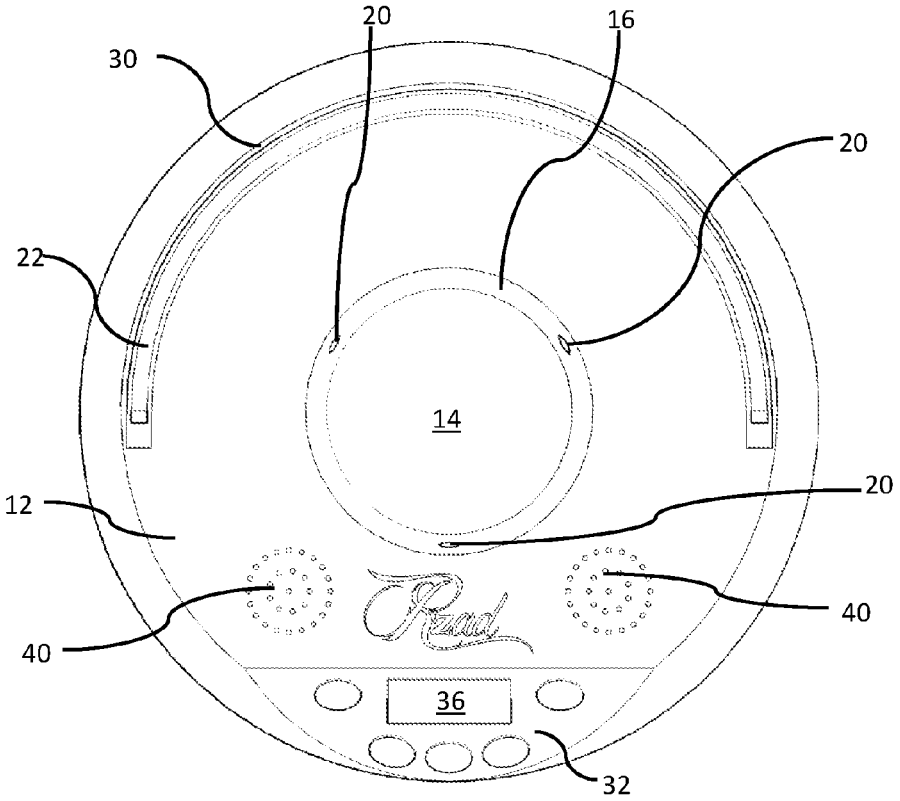
FIG. 2 illustrates a top view of an automatic candle blower in an embodiment of the present invention.

The arcuately-shaped arm 22 may preferably pivot on one or both of two ends 26, 28 thereof, and one or both of the ends 26, 28 may be connected to the base 12 for that purpose. FIG. 2 illustrates a top view of the automatic candle blower 10, showing the arcuately-shaped arm 22 within a resting slot 30, which may be its normal position when not in use. Therefore, a candle may be placed within the well 14 and lighted. A motor (not shown in FIG. 1), may pivot the arcuately-shaped arm out of the resting slot 30 to a position over a lighted candle resting within the well 14. A stream of air may stream from the plurality of air holes 24 to extinguish the flame of the lighted candle. In an embodiment, the stream of air may be a steady stream of air that may be provided by a blower (not shown in FIG. 1) within the base 12. Alternatively, the stream of air may be a blast of air provided by the blower. In any event, the blower may send the stream from the base 12 up through the arcuately-shaped arm 22 and out the plurality of holes 24.

The stream of air may continue out of the arcuately-shaped arm 22 for a sufficient period of time to extinguish the flame of the candle resting within the well 14. In alternate embodiments, sensors may be provided for detecting that the flame has been extinguished, such as one or more light sensors, smoke detectors, heat sensors, or combinations thereof for determining whether a flame is lit or has been extinguished. In another embodiment of the present invention, the blower may blow a steady stream of air out of the plurality of air holes 24 at a first, relatively low, level. If the sensors detect that the amount of air is insufficient to extinguish the flame, the blower may increase the amount of air flowing through the plurality of air holes 24 to ensure extinguishing of the flame.

Once the arm 22 has extended via the motor, and has extinguished the candle resting within the well 14, the automatic candle blower 10 may shut down the blower, and may stay extended until a user attends to the blower to push the arm 22 back into the resting slot 30. Alternatively, the motor may retract the arm 22 back into its resting slot 30 to be ready for future use.

In an alternate embodiment, the arcuately-shaped arm 22 may be engaged adjacent to the base 12, such as in the resting slot 30, via a latch (not shown) that may hold the arm 22 adjacent the base 12 or within the slot 30. Instead of a motor, a spring may be engaged to the arm 22 wherein the arm 22 may pivot due to release of tension within the spring. The spring may cause the arm to extend over the candle to extinguish a flame thereon via the blower. A user may reset the apparatus by pushing the arm 22 back adjacent the base 12 or within the slot 30, wherein the latch may catch and hold the arm in the down position.

It should be noted that the arcuately-shaped arm 22 may be a full arc, as shown in FIG. 1, extending from one side of the base 12 fully to the other side of the base 12. Alternatively, the arcuately-shaped arm 22 may be a partial arc, and may extend only partially from one end of the base 12 to the other. In such a case, the motor that may extend the arm 22 may be disposed on the same side of the base 12 as the blower, wherein only a first end of the arm 22 may be pivotally connected to the base 12, and the blower may blow a stream of air through the first end thereof. In addition, while the arm 22 is described and shown as arcuately-shaped, it should be apparent that any other shape may be utilized, such as a square-shaped arm, a triangular-shaped arm, or any other shape apparent to one of ordinary skill in the arm. The arcuately-shaped arm 22, as shown and described herein, may provide the necessary curve to focus the air stream to the flame of the candle to extinguish the same, and as such is particularly preferred.

A control panel 32 having a plurality of control buttons 34 and a display 36 may be provided on the base 12 to allow a user to control the automatic candle blower 10. The display 36 may be an LCD, LED, or other suitable type sufficient to provide information to the user necessary for operation of the embodiment, such as the current time, the programmed time for actuation of the air flow, time remaining until actuation, status and error codes, and the like. In an embodiment of the present invention, the user may program the time the user wishes the automatic candle blower to extinguish a flame of a candle resting therein. The user may program the specific time at which the user wishes to extinguish the candle (such as, for example, 11:00 pm) or the amount of time the user wishes until the automatic candle blower extinguishes the candle (such as, for example, 30 minutes). Thus, the control panel 32 may allow a user to program the present time and an extinguishing time, as desired.

The automatic candle blower 10 may further have one or more speakers 40 within the base 12 for playing sounds, such as music, nature sounds, or other like sounds. For example, the automatic candle blower 10 may connect to an audio source, either wired or wireless, to play the sounds. Specifically, the automatic candle blower 10 may connect through a Bluetooth wireless signal to a smart phone that may be send music to play through the speakers 40. More specifically, the base 12 may further have a button (not shown) for connecting the automatic candle blower 10 to a Bluetooth enabled device to receive an signal therefrom to play audio through the speakers 40. Of course, any audio source may be utilized, and the present invention should not be limited as described herein.

Preferably, the automatic candle blower 10 may be powered via any power source, including via DC power via batteries, or through an AC power cord plugged into standard wall outlet power, or both.

Figure 3:
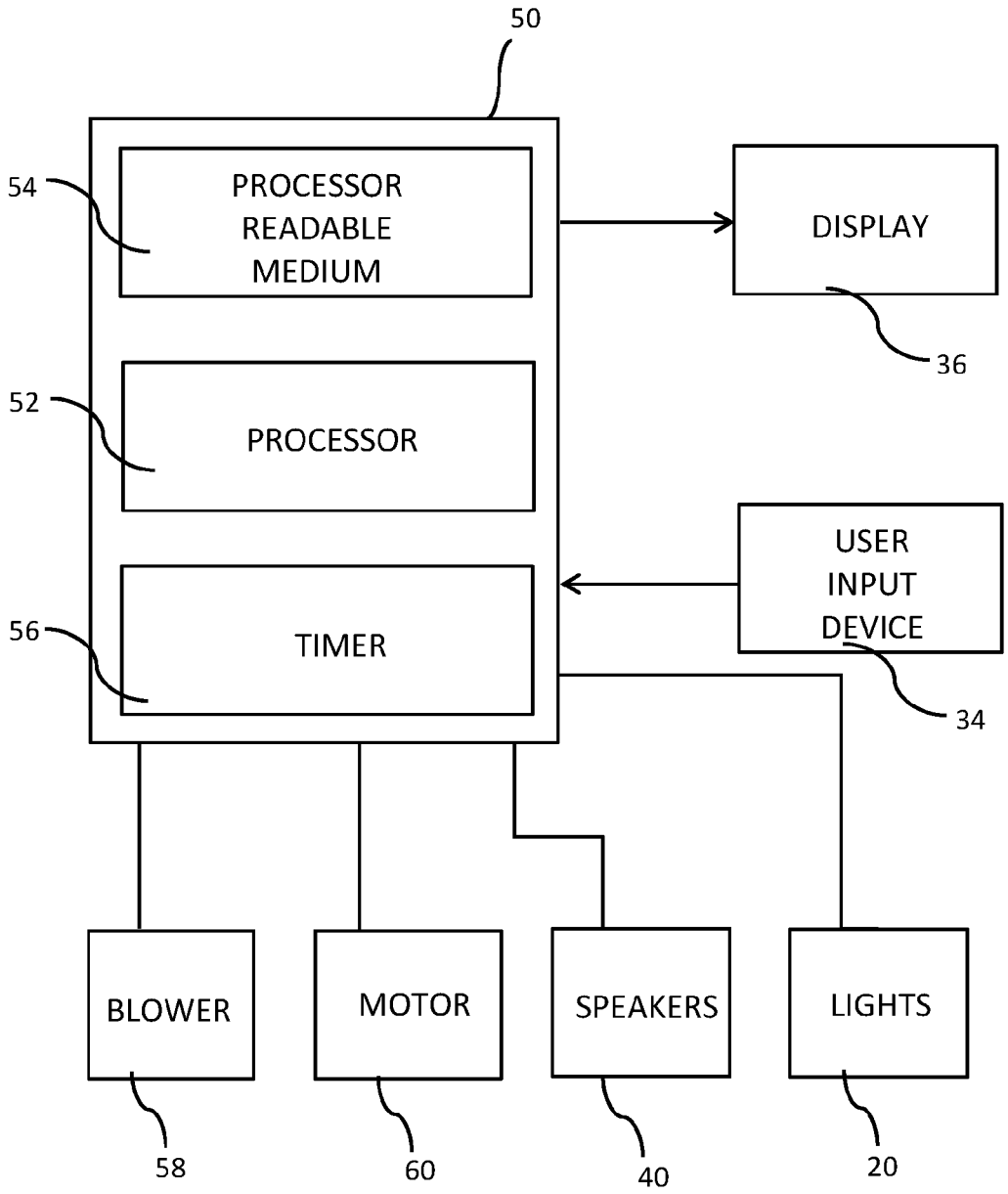
FIG. 3 illustrates a block diagram of electronic components of an automatic candle blower in an embodiment of the present invention.

FIG. 3 is a block diagram of the electrical components of the preferred embodiment. A control circuit 50 includes a processor 52 (e.g., a microprocessor or a PIC) electrically connected to both a processor readable medium 54 and a timer circuit 56. The control circuit 50 may receive input from the user control panel buttons 34 and return feedback to the user through a display 36. The control circuit 50 is further connected to the blower 58 to cause the activation and deactivation thereof, the motor 60 to cause the arm to extend over the lighted candle, the speakers 40 to play audio therethrough, and/or the lights 20 to shine.

It should be noted that various changes and modifications to the presently preferred embodiments described herein will be apparent to those skilled in the art. Such changes and modifications may be made without departing from the spirit and scope of the present invention and without diminishing its attendant advantages. Further, references throughout the specification to "the invention" are nonlimiting, and it should be noted that claim limitations presented herein are not meant to describe the invention as a whole. Moreover, the invention illustratively disclosed herein suitably may be practiced in the absence of any element which is not specifically disclosed herein.

I claim:

1. An automated candle blower comprising:

a base comprising a candle support surface and an arm pivotally connected to the base, wherein the arm comprises a down position and an extended position, wherein when in the down position the arm is adjacent and parallel with the candle support surface, wherein when the arm is in the extended position, the arm is configured to extend over a candle disposed on the candle support surface, wherein the arm further comprises a plurality of holes configured to direct a stream of air at the candle for extinguishing a flame on the candle when the arm is in the extended position;

a blower positioned to direct air within the arm and through the plurality of holes in the arm, wherein said directed air is configured to extinguishes the flame on the candle; and a timer configured to pivot the arm from the down position to the extended position so that the arm extends over the candle at a predetermined time.

2. The automated candle blower of claim 1 further comprising:

a control circuit having a processor and a timer, said control circuit being electrically connected to the blower; and a control panel electronically connected to the control circuit.

3. The automated candle blower of claim 1 further comprising:

a passage within the arm for directing air from the blower to the plurality of holes in the arm.

4. The automated candle blower of claim 1 wherein the arm is arcuately-shaped.

5. The automated candle blower of claim 4 wherein the arm extends arcuately from one side of the base to an opposing side of the base.

6. The automated candle blower of claim 4 wherein the arm extends arcuately partially from one side of the base to an opposing side of the base.

7. The automated candle blower of claim 1 wherein the candle support surface comprises a well within the base.

8. The automated candle blower of claim 7 wherein the well comprises a bottom surface and at least one support wall.

9. The automated candle blower of claim 8 further comprising:

at least one light on the support wall configured to shine against the candle held within the well.

10. The automated candle blower of claim 9 wherein the light is an LED.

11. The automated candle blower of claim 1 wherein the plurality of holes is oriented to direct air radially toward the candle.

12. The automated candle blower of claim 1 wherein the plurality of holes are angled downwardly relative to a horizontal plane.

13. The automated candle blower of claim 1 further comprising:

a speaker within the base configured to play sounds.

14. A method of extinguishing a candle comprising the steps of:

providing a base comprising a candle support surface and an arm pivotally connected to the base, wherein the arm comprises a down position and an extended position, wherein when in the down position the arm is adjacent and parallel with the candle support surface, wherein when the arm is in the extended position, the arm is configured to extend over a candle disposed on the candle support surface, wherein the arm further comprises a plurality of holes configured to direct a stream of air at the candle for extinguishing a flame on the candle when the arm is in the extended position, a blower positioned to direct air within the arm and through the plurality of holes in the arm, wherein said directed air extinguishes the flame on the candle, and a timer configured to pivot the arm so that the arm extends over the candle at a predetermined time;

supporting a candle on the candle support surface;

activating a blower at a first time;

pivoting the arcuately-shaped arm to extend over the candle on the candle support surface;

directing air flow from the blower to the plurality of holes in the arm, wherein the air flow extinguishes a lit candle; and deactivating the blower.

15. The method of claim 14 further comprising the steps of:

accepting first user input with a control panel, the user input being representative of the value of a first time variable;

providing the first user input to a control circuit electrically connected to the blower, the control circuit comprising a processor and a timer; and deriving the first time from the first time variable.

16. The method of claim 15 further comprising the steps of:

accepting second user input with the control panel, the second user input representative of the value of a second time variable;

providing said second user input to the control circuit;

deriving a second time from the second time variable; and deactivating the blower at the second time.

17. The method of claim 14 wherein the directing step comprises the step of channeling air flow through a passage within the arm and through the plurality of air holes.

18. The automated candle blower of claim 1 wherein the base comprises a slot, and further wherein the arm resides within the slot when the arm is in the down position.

19. The automated candle blower of claim 18 wherein the arm is flush with the base when the arm is in the down position and rests within the slot.

20. The method of claim 14 wherein the base comprises a slot, and further wherein the arm resides within the slot and is flush with the base when the arm is in the down position.

* * * * *